United States Patent [19]

Ottenhues

[11] Patent Number: 4,463,675

[45] Date of Patent: Aug. 7, 1984

[54] DOCTOR DEVICE

[75] Inventor: Ludger Ottenhues, Tecklenburg, Fed. Rep. of Germany

[73] Assignee: Windmoller & Holscher, Lengerich, Fed. Rep. of Germany

[21] Appl. No.: 326,071

[22] Filed: Nov. 30, 1981

[30] Foreign Application Priority Data

Dec. 1, 1980 [DE] Fed. Rep. of Germany ..... 3045191
Jan. 16, 1981 [DE] Fed. Rep. of Germany ..... 3101300

[51] Int. Cl.[3] ..... B41F 9/10

[52] U.S. Cl. ..... 101/157; 101/169; 101/365

[58] Field of Search ..... 101/157, 169, 365

[56] References Cited

U.S. PATENT DOCUMENTS

| | | | |
|---|---|---|---|
| 2,920,557 | 1/1960 | Fuchs | 101/157 |
| 3,057,294 | 10/1962 | Jameson | 101/365 |
| 3,128,207 | 4/1964 | Schmitt | 101/169 |
| 3,593,663 | 7/1971 | Vischulis | 101/157 |
| 3,783,781 | 1/1974 | Grommek | 101/169 |
| 4,040,349 | 8/1977 | Jeschke | 101/365 |

FOREIGN PATENT DOCUMENTS

| | | | |
|---|---|---|---|
| 432036 | 7/1926 | Fed. Rep. of Germany | 101/365 |
| 2057689 | 12/1971 | Fed. Rep. of Germany | 101/365 |
| 168933 | 9/1921 | United Kingdom | 101/365 |
| 1222700 | 2/1971 | United Kingdom | 101/169 |
| 1316105 | 5/1973 | United Kingdom | 101/157 |

*Primary Examiner*—Clyde I. Coughenour
*Attorney, Agent, or Firm*—Fleit, Jacobson, Cohn & Price

[57] ABSTRACT

In a doctor device comprising a doctor blade which is applicable to a plate cylinder of a printing press and is located in a doctor holder, the holder is pivotally connected to a beam parallel thereto by at least one leaf spring. A plurality of piston-cylinder units disposed on the beam in a row have their piston rods applied directly or indirectly by way of pressure bolts to the holder or a part connected thereto. The piston-cylinder units are fed by a pressure medium at an adjustable basic pressure. Each piston-cylinder unit is associated with a separately adjustable fine regulating valve by way of which an additional pressure can be superimposed on the basic pressure by introducing additional pressure medium.

3 Claims, 4 Drawing Figures

DOCTOR DEVICE

The invention relates to a doctor device comprising a doctor blade which is applicable to a plate cylinder, is located in a doctor holder and is provided with means for setting its application pressure which is differently variable over its length.

In a doctor device of this kind known from DE-PS No. 11 42 877, there is a row of spindles of which the front ends are supported directly on the doctor blade and which are axially displaceable but non-rotatable in rotatably mounted rings. To turn the spindles, endless belts are provided which pass about direction-changing rollers by means of a remote control and which, with the aid of magnetically or pneumatically controlled pressure rollers, can be pressed against the surfaces of the rings so as to be carried along thereby under friction. For the purpose of manual actuation, the spindles carry actuating buttons at their rear ends. The known device not only has a complicated construction but is also difficult to manipulate to provide reproducible results and does not permit sufficiently fine adjustment of the pressure means for acting on the doctor blade at a different pressure.

It is therefore the problem of the invention to provide a doctor device of the aforementioned kind which is simple to construct, easier to manipulate and permits the reproducible setting of different pressing forces over the length of the doctor blade.

According to the invention, this problem is solved in that the holder for the doctor blade is pivotably connected to a beam parallel thereto by at least one leaf spring, that a plurality of piston-cylinder units disposed on the beam in a row have their piston rods applied directly or indirectly by way of pressure bolts to the holder or a part connected thereto, that the piston-cylinder units are fed by a pressure medium at an adjustable basic pressure, and that each piston-cylinder unit is associated with a separately adjustable fine regulating valve by way of which an additional pressure can be superimposed on the basic pressure by introducing additional pressure medium. The pivotable mounting of the holder of the doctor blade by means of leaf springs in accordance with the combination of the invention permits a flexible adaptation of the doctor blade to the plate cylinder because there is no undesirable stressing in rigid bearings that would otherwise have to be taken up by the flexibility of the doctor blade. The piston cylinder units disposed at intervals over the length of the holder of the doctor blade first of all act on the holder with equal pressing forces which, however, can be varied in sections over the length of the doctor blade in the desired manner by means of the fine regulating valve. The sectional fine adjustment can be carried out by hand through remote control or automatically according to a predetermined programme. Finally, the pressing force of the doctor blade on the plate cylinder can be measured by suitable converters and the fine regulating valves can be controlled according to the measured values. The pressure medium is preferably air but could also be hydraulic liquid.

Mounting a holder for a doctor blade on leaf springs is known per se from DE-AS No. 19 64 118. However, this known mounting is not a pivot mounting but merely serves for the low-friction support of the holder at right-angles to the doctor movement, the back of the holder being supported in the direction of the doctor movement on a pressure measuring device which is secured to the doctor table.

GB-PS No. 13 16 105 discloses a rocker bearing for the holder of a doctor blade about an axis parallel to the plate cylinder axis, inflatable flexible tubes being disposed at both sides of the bearing between the holder and the beam for mounting same. By inflating the tubes, one can vary the pressure exerted by the doctor blade on the plate cylinder.

Finally, DE-PS No. 20 57 689 discloses a doctor device in which, for the purpose of applying and withdrawing the doctors to and from the plate cylinder, provision is made for piston-cylinder units which are connected to the doctor carriers and have stepless pistons. The larger piston ring area is impinged by a pressure medium which controls the application and withdrawal motions. A smaller piston area divided off by seals can be fed, independently of the means for controlling the application and withdrawal motions, with a pressure medium for the simultaneous and uniform fine adjustment of the doctors. With the aid of the two last-mentioned doctor devices, it is not possible to exert a different pressure over the length of the doctor blade.

According to a development of the invention, the leaf spring carries at the end opposite to the holder a clamp member which is insertable in a complementary recess of the beam and held therein by a locking device actuated by at least one piston-cylinder unit. To exchange the doctor holder with doctor blade, it is merely necessary to withdraw the doctor blade from the plate cylinder, actuate the piston-cylinder unit and replace the doctor holder with another. Replacement can be carried out particularly rapidly and simply if the piston-cylinder unit is fed. The apparatus according to the invention thus not only permits a desired different pressure of the doctor blade over its length but the holder with blade can also be particularly simply and rapidly exchanged for a new one, the pressure conditions for the doctor blade being simply reproducible.

An example of the invention will now be described in more detail with reference to the drawing, wherein.

Figure 1:
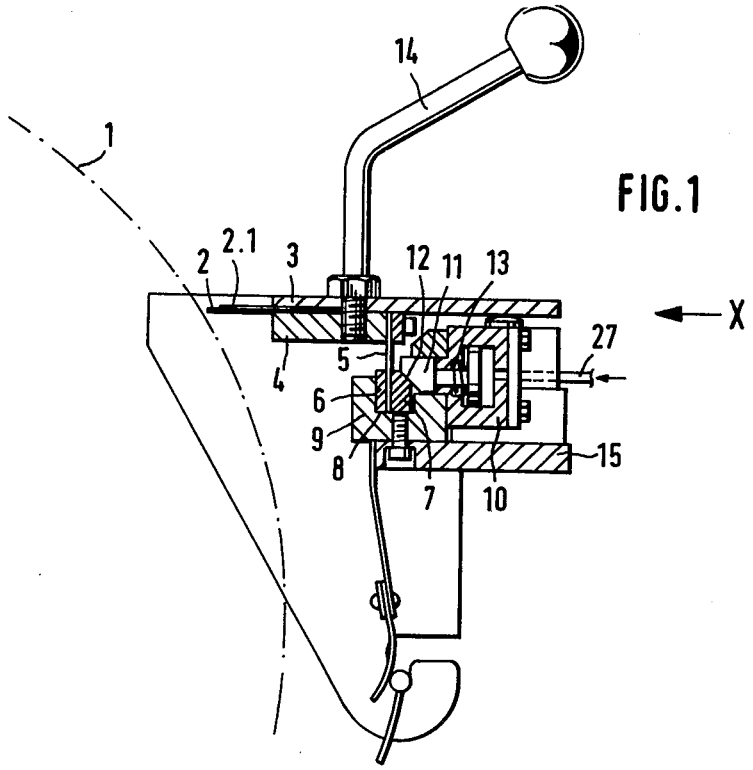
FIG. 1 is a section through the doctor device on the line I—I in FIG. 3.
Figure 2:
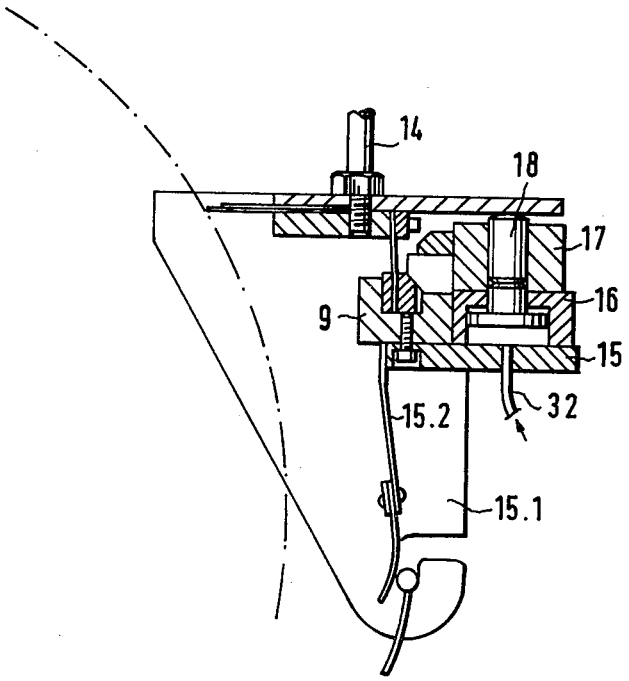
FIG. 2 is a section of the doctor device on the line II—II in FIG. 3.
Figure 3:
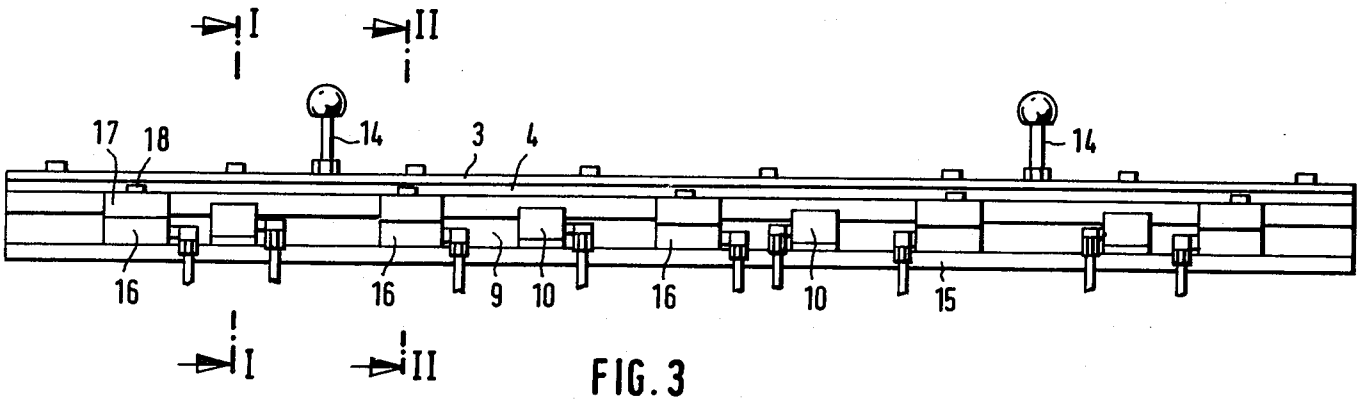
FIG. 3 is an elevation of the doctor device in the direction of the arrow X in FIG. 1

Applied to a plate cylinder 1 there is a doctor knife 2 with supporting doctor 2.1 of a doctor which is held between a doctor beam 3 and a bar 4. A leaf spring 5 connected to the bar 4 is perpendicular to the doctor beam 3. The lower free end of the leaf spring 5 which extends over the entire length of the doctor is clamped between two bars 6 and 7 of equal length. The bars 6 and 7 are disposed in a groove 8 of a rail 9 which has the same length as the doctor. Four pressure cylinders 10 are secured to the rail 9 and a pressure member 11 having an oblique face 12 is seated on their piston rod. The bar 7 has an oblique angle complementary to the oblique face 12. In FIG. 1, the piston of the pressure cylinder 10 is shown in the projected condition so that the pressure member 11 pushes the bars 6, 7 into the corner of the groove 8 diametrally opposite the oblique face 12. In front of the piston of the pressure cylinder 10 there is a compression spring 13 which pushes the piston to the right when the pressure of the pressure medium is switched off. In the unpressurised condition, the bars 6, 7 are free so that the doctors can be readily removed from their operative position by means of the handle 14. A bar 15 fixed to the rail 9 is secured on the doctor carrier (not shown) with which the side plates 15.1 disposed on the right and left-hand sides as well as the defecting plate 15.2 are also connected and on which the five pressure cylinders 16 are arranged, of which the piston rod acts on the underside of the doctor beam 3 by way of a pressure bolt 18 guided in a guide member 17. When a pressure medium acts on the pressure cylinder 16, a force is exerted on the doctor beam 3 that presses the doctor blade 2 against the plate cylinder 1 while bending the leaf spring 5. The size and location of these pressure forces are freely selectable. so that, for example, the two left-hand pressure cylinders 16 can exert a strong force and the others merely a weak force.

Figure 4:
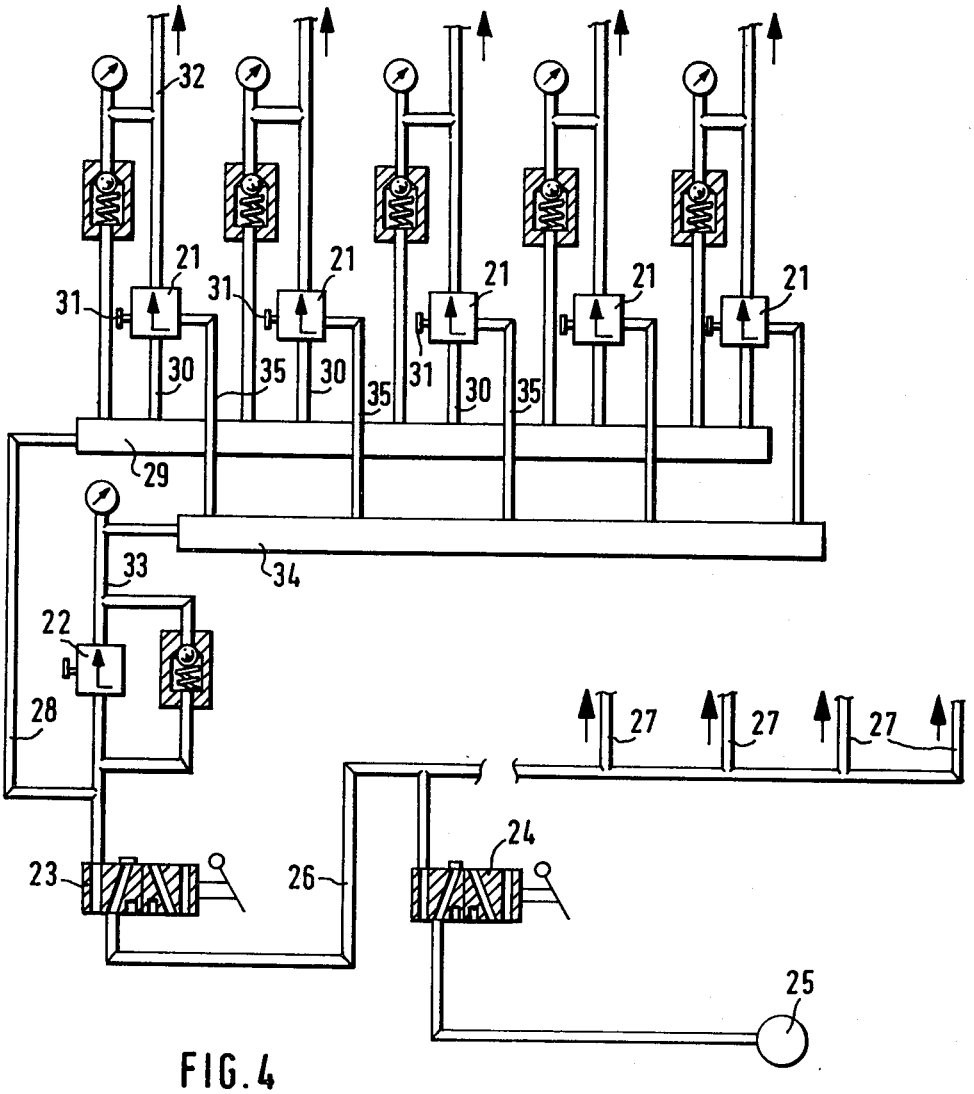
FIG. 4 is a pneumatic circuit diagram.

The pneumatic circuit diagram of FIG. 4 shows a control for the pressure cylinders 16. The control consists of five fine regulating valves 21 one for each pressure cylinder 16, and a fine regulating valve 22 with which a basic value is set for the pneumatic pressure to the regulating valves 21. The pressure of the pressure medium can be turned on and off by means of a control slide valve 23. The control slide valve 23 is preceded by a slide valve 24 with which there are connected a pressure medium source 25 with a conduit 26 for the pressure cylinders 16 and with conduits 27 which lead to the pressure cylinders 10. The fine regulating valves 21 are fed with pressure medium through conduits 28, 29, 30. By means of a set screw 31 on the fine regulating valve 21, one can add pressure to the pressure cylinders 16 through the conduits 32. The fine regulating valve 22 feeds pressure medium through conduits 33, 34, 35 into the fine regulating valves 21 and into conduits 32 and this pressure in conduits 32 is superimposed on by the pressure from conduits 30 as controlled by valves 21. Thus, a basic pressure is preselected by the fine regulating valve 22 and it can be increased individually in each pressure cylinder 16 by the addition of fluid by means of the set screws 31. The force of the doctor can thus be adjusted at will in sections.

On replacing the doctor blade, the blade is first of all withdrawn with the slide valve 23 and the lock is then released with the slide valve 24. After replacement and renewed application of the blade, the previous pressure conditions will again obtain.

I claim:

1. A doctor device applicable to a plate cylinder comprising:

an elongated beam adapted to be fixed parallel to the surface of a plate cylinder;

an elongated doctor blade holder extending in the same direction as the beam and spaced therefrom;

a doctor blade mounted in said doctor blade holder;

at least one leaf spring pivotably connecting said beam to said doctor blade holder;

a plurality of piston-cylinder units disposed along the length of said beam;

a plurality of piston rod means, extending from said plurality of piston-cylinder units, for contacting said doctor blade holder to urge the doctor blade into an operative position against the surface of a plate cylinder;

means for feeding a pressure medium at an adjustable basic pressure to said piston-cylinder units;

fine regulating valve means associated with said piston-cylinder units and being fed with an additional pressure whereby the additional pressure can be selectively and controllably superimposed on the piston-cylinder units;

clamp means connected to said leaf spring at the end opposite to said doctor blade holder, said clamp means being seated in a complementary recess of said beam; and locking means, locking said clamp means in said recess of said beam, said locking means includes at least one piston-cylinder unit connected to the same pressure medium source as said plurality of piston-cylinder units.

2. A doctor device according to claim 1, wherein said leaf spring is connected to said beam and to said holder substantially at right-angles.

3. A doctor device applicable to a plate cylinder comprising:

an elongated beam adapted to be fixed parallel to the surface of a plate cylinder;

an elongated doctor blade holder extending in the same direction as the beam and spaced therefrom;

a doctor blade mounted in said doctor blade holder;

at least one leaf spring pivotably connecting said beam to said doctor blade holder, said leaf spring connected to said beam and to said holder substantially at right-angles;

a plurality of piston-cylinder units disposed along the length of said beam;

a plurality of piston rod means, extending from said plurality of piston-cylinder units, for contacting said doctor blade holder to urge the doctor blade into an operative position against the surface of a plate cylinder;

means for feeding a pressure medium at an adjustable basic pressure to said piston-cylinder units;

fine regulating valve means associated with said piston-cylinder units and being fed with an additional pressure whereby the additional pressure can be selectively and controllably superimposed on the piston-cylinder units;

a clamp means connected to said leaf spring at the end opposite to said doctor blade holder, said clamp means being seated in a complementary recess of said beam; and locking means, locking said clamp means in said recess of said beam, said locking means includes at least one piston-cylinder unit connected to the same pressure medium source as said plurality of piston-cylinder units.

* * * * *